US006331045B1

(12) United States Patent
Harvey et al.

(10) Patent No.: US 6,331,045 B1
(45) Date of Patent: Dec. 18, 2001

(54) DROP ON DEMAND INK JET PRINTING APPARATUS

(75) Inventors: Robert A. Harvey; Stephen Temple, both of Cambridge (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/804,849

(22) Filed: Mar. 13, 2001

Related U.S. Application Data

(63) Continuation of application No. PCT/GB99/03173, filed on Sep. 23, 1999.

(30) Foreign Application Priority Data

Sep. 23, 1998 (GB) ..... 9820755

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27; 399/261; 361/700; 310/328–330; 29/890.1

(56) References Cited

U.S. PATENT DOCUMENTS 5,255,016 10/1993 Usui et al. .
5,459,501 10/1995 Lee et al. .
5,757,401 5/1998 Abe et al. .

FOREIGN PATENT DOCUMENTS 0 416 540 A2 3/1991 (EP) .

OTHER PUBLICATIONS

International Search Report for PCT/GB99/03173 dated Jan. 12, 2000.
International Preliminary Examination Report for PCT/GB99/03173 dated Dec. 7, 2000.

*Primary Examiner*—Raquel Yvette Gordon
(74) *Attorney, Agent, or Firm*—Marshall, Gerstein & Borun

(57) ABSTRACT

Drop-on-demand ink jet printing apparatus comprises a nozzle on a nozzle axis; an ink chamber communicating with the nozzle, a piezoelectric actuating structure, said structure extending around the nozzle axis and extending in the direction of the nozzle axis; an actuating surface facing the nozzle, said structure being actuable to move said actuating surface in the direction of the nozzle axis to effect droplet ejection through the nozzle; and electrodes for applying an actuating electric field to the actuating structure.

49 Claims, 11 Drawing Sheets

DROP ON DEMAND INK JET PRINTING APPARATUS

This is a continuation of International Application No. PCT/GB99/03173 filed Sep. 23, 1999, the entire disclosure of which is incorporated herein by reference.

BACKGROUND OF THE INVENTION

This invention relates to drop on demand ink jet printing apparatus and, in one example, to drop on demand ink jet printing apparatus having a two dimensional array of ink chambers.

Our co-pending PCT patent application no. PCT/GB98/01955 describes a drop on demand inkjet apparatus which utilises a piezoelectric actuating disc arranged so as to deflect in shear mode. The apparatus is formed of a plurality of laminated plates arranged so as to define an ink chamber. The actuator forms one side of the chamber and deflects towards a nozzle formed in a nozzle plate which provides the opposite side of the chamber. When a charge is applied between electrodes formed on the actuator, the piezoelectric disc deflects in shear mode towards the nozzle plate. An acoustic pressure wave travels radially within the chamber, is reflected from the side walls of the chamber to dissipate the energy stored in the ink and actuator, and converges again in the centre of the chamber to effect ejection of ink from the chamber. The volume strain or condensation as the pressure wave recedes from the nozzle develops a flow of ink from the nozzle outlet aperture for a period R/c, where c is the effective acoustic velocity of ink in the chamber and R is the radial distance to the walls of the chamber. A droplet of ink is expelled during this period. After time R/c the pressure becomes negative, ink emission ceases and the applied voltage can be removed. Subsequently, as the pressure wave is damped, ink ejected from the chamber is replenished and the droplet expulsion cycle can be repeated. By the application of a number of pulses in quick succession it is possible to increase the size of the droplet ejected and hence build up a number of grey levels.

SUMMARY OF THE INVENTION

The preferred embodiments of the present invention seek to extend this concept to provide further improvements in drop on demand ink jet printing.

In a first aspect, the present invention provides drop-on-demand ink jet printing apparatus comprising a nozzle on a nozzle axis; an ink chamber communicating with the nozzle; a piezoelectric actuating structure, said structure extending around the nozzle axis and extending in the direction of the nozzle axis; an actuating surface bounding the chamber and facing towards the nozzle, said structure being actuable to move said actuating surface in the direction of the nozzle axis to effect droplet ejection through the nozzle; and electrodes for applying an actuating electric field to the actuating structure.

Preferably, the electrodes comprise a first electrode on a face of the actuating structure abutting the ink chamber and a second electrode on an opposing face of the actuating structure isolated from the ink chamber.

In a second aspect, the present invention provides drop-on-demand ink jet printing apparatus comprising a nozzle on a nozzle axis; an ink chamber communicating with the nozzle; a piezoelectric actuating structure, said structure extending in the direction of the nozzle axis; an actuating surface bounding the chamber and facing towards the nozzle, said structure being actuable to move said actuating surface in the direction of the nozzle axis to effect droplet ejection through the nozzle; and electrodes for applying an actuating electric field to the actuating structure, said electrodes comprising a first electrode on a face of the actuating structure abutting the ink chamber and a second electrode on an opposing face of the actuating structure isolated from the ink chamber. The first electrode is preferably ground.

The ink chamber may extend radially about the nozzle axis, and the-actuating structure may be actuable to move the actuating surface in the direction of the nozzle axis to effect, through acoustic wave travel in the ink chamber radially of the axis of the nozzle, droplet deposition through the nozzle.

Preferably, the ink chamber extends a radial distance R from the nozzle axis and the actuating structure is actuable to move in the direction of the nozzle axis in a time which is at most half of the time R/c, where c is the speed of sound through ink in the ink chamber.

The ink chamber may be bounded by a generally circular structure providing a change in acoustic impedance serving to reflect acoustic waves travelling in the ink chamber radially of the nozzle axis. The change in acoustic impedance may be effected through a change in ink depth in the direction of the nozzle axis.

The circular structure may define an annulus of ink about the ink chamber which in the direction of the nozzle axis is of a depth different from the depth of the ink chamber.

Preferably, the apparatus further comprises ink supply means in fluid communication with the ink chamber for replenishment of the ink chamber following droplet ejection.

The ink supply means may be disposed at a plurality of locations disposed circumferentially about the ink chamber.

The ink supply means may serve to supply ink to the ink chamber around substantially the entire periphery of the ink chamber.

The actuating structure may taper towards the nozzle axis.

In one preferred embodiment, the actuating structure is homogeneous and so poled in relation to the actuating electric field as to deflect in direct mode. The actuating structure may be poled in a direction transverse to the faces thereof, the electric field being applied in a direction transverse to the faces of the actuating structure.

Alternatively, the actuating structure may be homogeneous and so poled in relation to the actuating electric field as to deflect in shear mode. The actuating structure may be poled in directions which converge towards the nozzle axis, the electric field being applied in a direction transverse to the faces of the actuating structure.

The actuating surface may comprise a disc of piezoelectric material, the piezoelectric disc being poled in the direction of the nozzle axis so as to deflect in direct mode upon actuation of the electric field.

The apparatus may comprise a plurality of said nozzles, each having a respective nozzle axis, said nozzle axes being provided in parallel; a plurality of said ink chambers, each extending about a respective nozzle axis; and a homogeneous piezoelectric sheet having a two dimensional array of said actuating structures, each actuating structure being associated with a respective ink chamber.

In a third aspect, the present invention provides a method of ink jet printing comprising the steps of establishing a planar body of ink in communication with a nozzle having a nozzle axis, the body of ink extending radially of the nozzle axis; providing in the body of ink an impedance boundary extending circumferentially of the nozzle axis; and selectively actuating a piezoelectric actuating structure extending in the direction of the nozzle axis and around the nozzle axis to move an actuating surface in the direction of the nozzle axis so as to establish an acoustic wave travelling radially of the nozzle axis in the ink chamber and reflected by the impedance boundary, thereby to effect ejection of an ink droplet through the nozzle.

In a fourth aspect, the present invention provides a method of manufacturing drop-on-demand ink jet printing apparatus, comprising the steps of forming a nozzle plate having a two dimensional array of nozzles each having a nozzle axis, said nozzle axes being in parallel; forming a two dimensional array of actuating structures on a substrate each extending in the direction of a respective nozzle axis and around the respective nozzle axis and being associated respectively with the nozzles, an actuating surface being provided for each actuating structure; applying electrodes on the actuating structures enabling selective actuation of each wall; and laminating the nozzle plate and the substrate; the laminated structure providing a plurality of disc-shaped ink chambers each extending about a respective nozzle axis and communicating with the respective nozzle, such that in the manufactured apparatus, actuation of a selected structure effects drop ejection from the associated nozzle.

Features described above relating to apparatus aspects of the present invention can also be applied to method aspects, and vice versa.

The present invention extends to drop-on-demand ink jet printing apparatus, comprising a nozzle on a nozzle axis; an ink chamber extending radially about the nozzle axis; ink supply means communicating with the ink chamber; an actuating surface; and an actuator for the actuating surface having a length extending in the direction of the nozzle axis, the actuator being actuable to move the actuating surface in the direction of the nozzle axis to effect, through acoustic wave travel in the ink chamber radially of the nozzle axis, ejection of an ink drop through the nozzle and replenishment of the ink chamber with ink.

The present invention also extends to drop-on-demand ink jet printing apparatus comprising a two-dimensional array of nozzles, each having a nozzle axis, the nozzle axes being provided in parallel; a plurality of disc-shaped ink chambers each extending about a respective nozzle axis and communicating with the respective nozzle; a homogeneous piezoelectric sheet having a two dimensional array of circularly symmetric actuating structures each having a length extending in the direction of respective nozzle axes and being associated with a respective ink chamber, each circularly symmetric wall being bridged by a respective disc-shaped roof member; and electrodes on the piezoelectric sheet enabling selective actuation of each wall thereby to eject a droplet from the associated nozzle.

The present invention also provides a method of manufacturing drop-on-demand ink jet printing apparatus, comprising the steps of forming a nozzle plate having a two dimensional array of nozzles each having a nozzle axis, the nozzle axes being in parallel; forming a homogenous piezoelectric sheet having a two dimensional array of circularly symmetric actuating structures each having a length extending in the direction of a respective nozzle axis and being associated respectively with the nozzles, each circularly symmetric wall being bridged by a respective disc-shaped roof member; applying electrodes on the piezoelectric sheet enabling selective actuation of each wall; and laminating the nozzle plate and the piezoelectric sheet; the laminated structure providing a plurality of disc-shaped ink chambers each extending about a respective nozzle axis and communicating with the respective nozzle, such that in the manufactured apparatus, actuation of a selected wall of the piezoelectric sheet effects drop ejection from the associated nozzle.

The plurality of ink chambers may be provided by a two dimensional array of circularly symmetric recesses formed in the piezoelectric sheet, each roof member comprising at least part of the bottom wall of a respective circularly symmetric recess.

The electrical connections to individual electrodes may be formed on an interconnection plate mounted on the piezoelectric sheet. The nozzle plate and the interconnection plate may be formed from piezoelectric material. Alternatively, the nozzle plate and the interconnection plate may be formed from material thermally compatible with the piezoelectric sheet.

An array of ink channels may be formed in the piezoelectric sheet for supplying ink to the ink chambers.

Each ink chamber may be bounded by a generally circular structure which, in the manufactured apparatus, provides a change in acoustic impedance serving to reflect acoustic waves travelling in the ink chamber radially of the respective nozzle axis.

BRIEF DESCRIPTION OF THE DRAWINGS

Preferred features of the present invention will now be described, by way of example, with reference to the accompanying drawings in which:

FIG. 1(*b*) is a top perspective view of a two-dimensional array of actuators formed in piezoelectric sheet;

FIG. 1(*c*) is a rear perspective view of the piezoelectric sheet shown in FIG. 1(*b*);

FIG. 8(*b*) is a top perspective view of the actuator shown in FIG. 8(*a*);

FIG. 8(*c*) is a simplified diagram of an array of actuators as shown in FIG. 8(*a*);

FIG. 8(*d*) is a diagram for illustrating a method of manufacturing of an actuator as shown in FIG. 8(*a*);

FIG. 9(*b*) is a simplified diagram of an array of actuators as shown in FIG. 9(*a*);

FIG. 10(*b*) illustrates a technique for bonding the actuator shown in FIG. 10(*a*) to a substrate.

DETAILED DESCRIPTION OF THE PREFERRED EMBODIMENTS

Figure 1A:
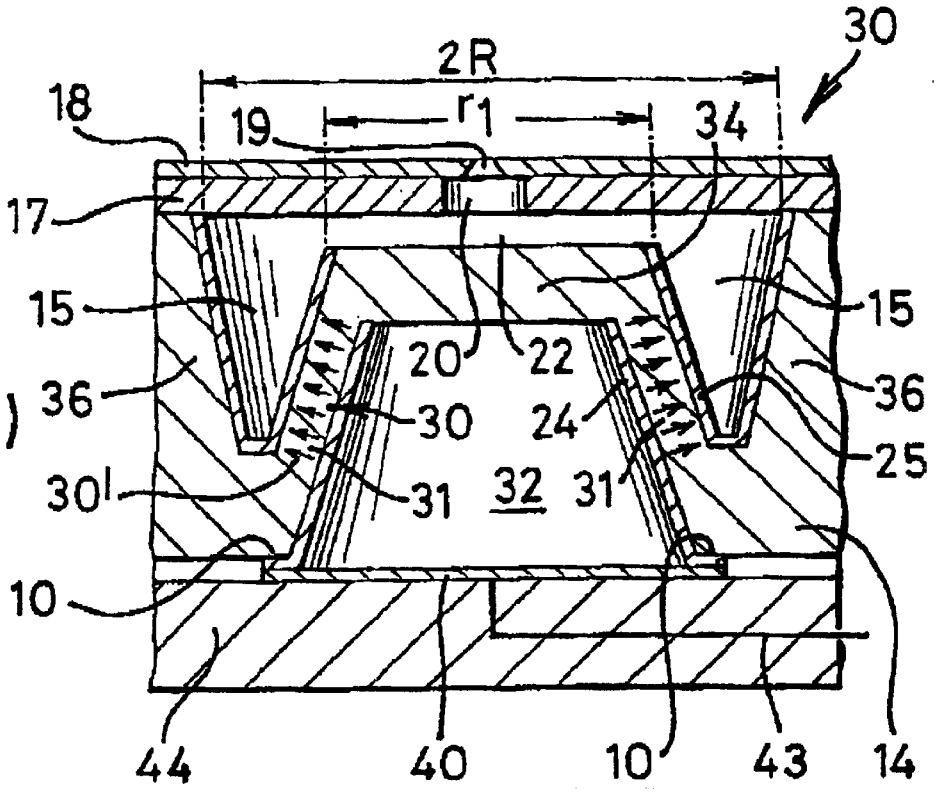
FIG. 1(*a*) is a sectional view of a first embodiment of a single actuator of a drop-on-demand ink jet printing apparatus.
Figure 1B:
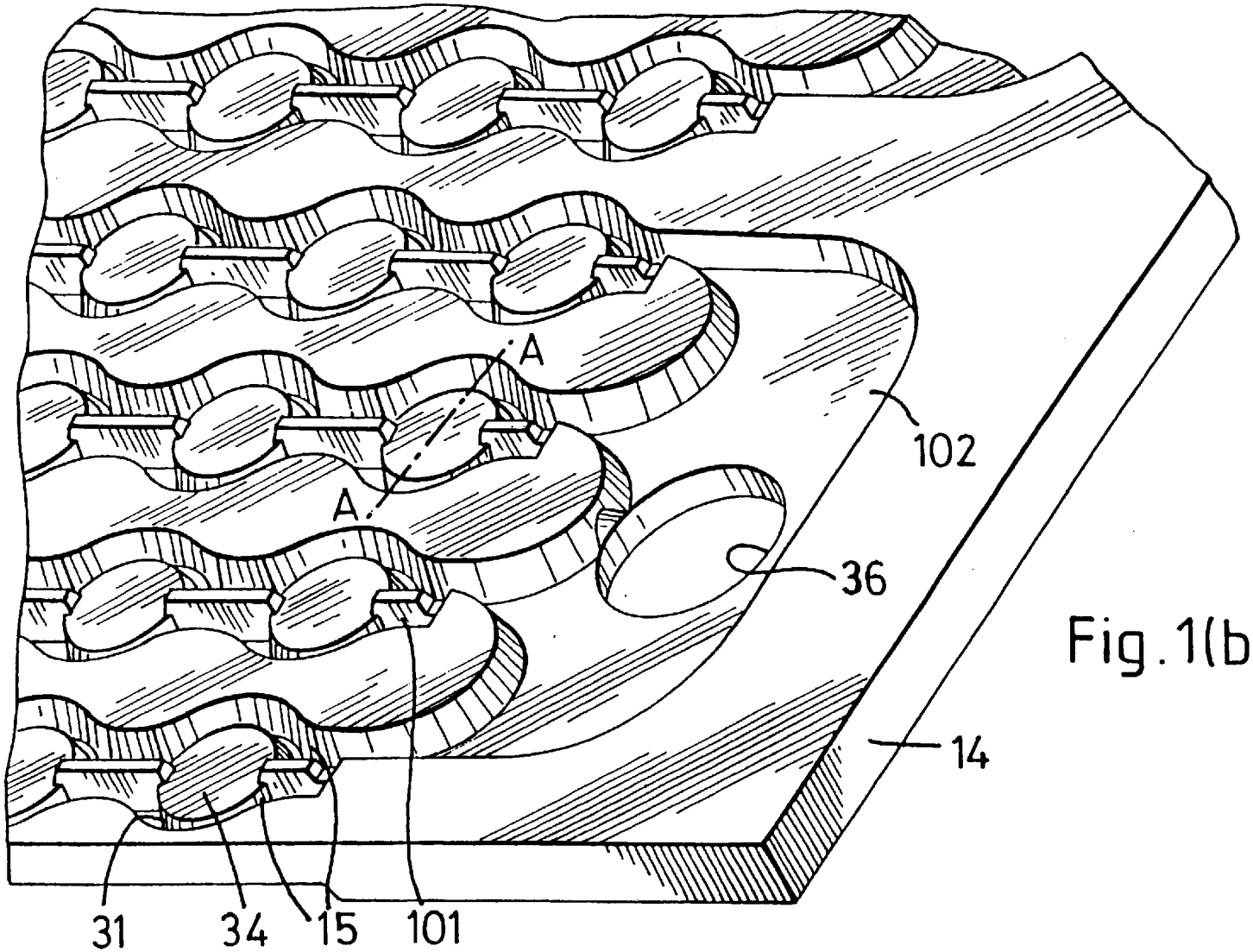
Figure 1C:
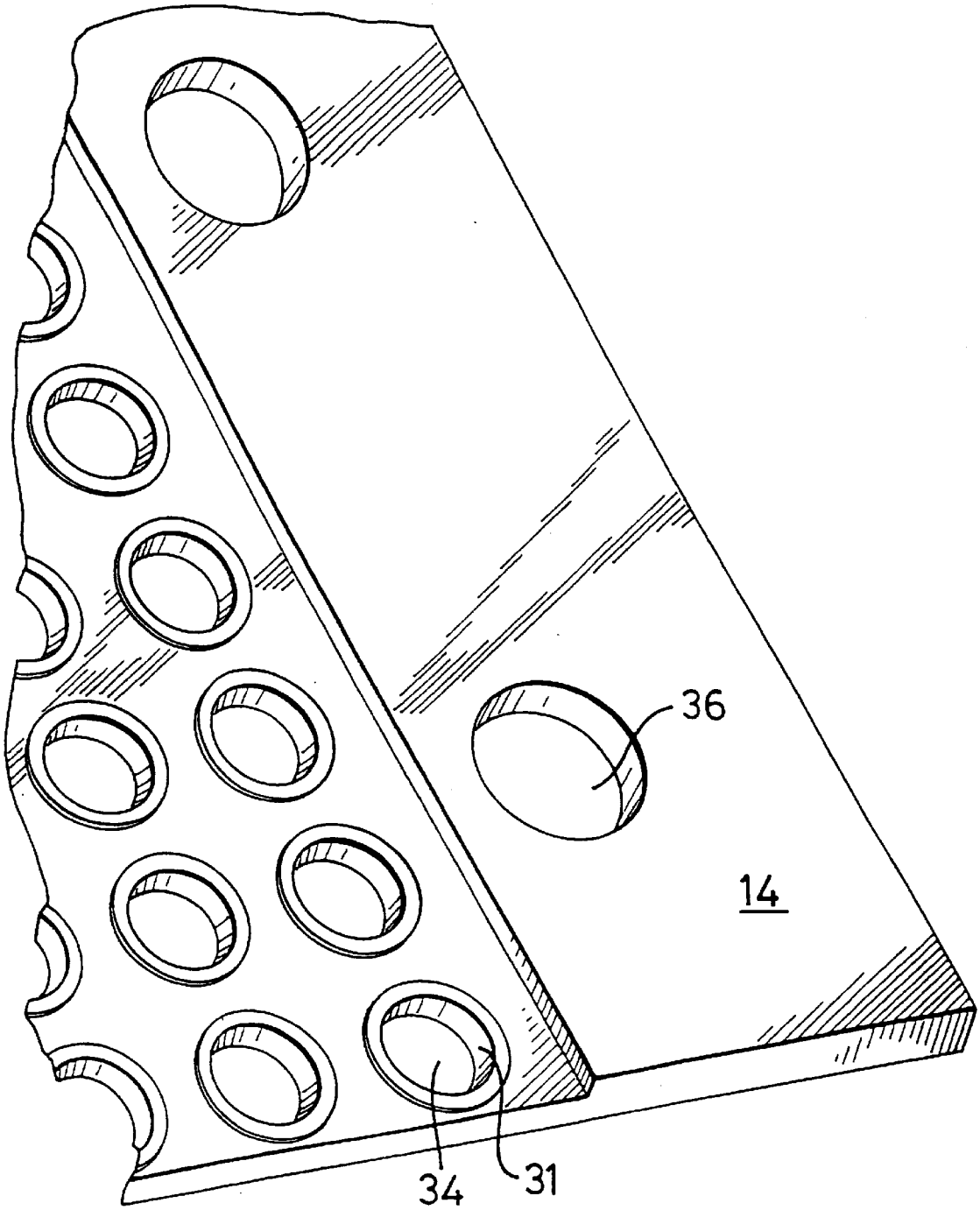

FIG. 1(*a*) shows a sectional view of a single actuator 30 formed in a piezoelectric sheet 14 of a drop-on-demand ink jet printing apparatus according to a first embodiment of the present invention. The piezoelectric sheet 14, interposer plate 17 and nozzle plate 18 define an ink chamber 22 which extends radially about the axis of the nozzle 19 formed in the nozzle plate 18. The ink chamber 22 communicates with the nozzle 19 via an orifice 20 formed in the interposer plate 17. As shown in FIG. 1(*a*), the piezoelectric sheet 14 forms part of a laminated structure which includes an interposer plate 17, a nozzle plate 18 and a substrate 44.

The ink chamber 22 is supplied with ink by means of a pair of ink channels 15 formed in the piezoelectric sheet and disposed circumferentially around the ink chamber 22. As shown in FIG. 1(*b*), the ink channels 15 are in fluid communication with manifolds 102 formed in the piezoelectric sheet 14, which in turn are supplied from an ink reservoir (not shown) via duct 36.

Furthermore, the connection of channels 15 to opposite sides of the ink chamber allows ink to be circulated through a row of chambers 22 for dirt and air removal purposes, as is generally known in the art. This is more evident in FIG. 1(*b*), which is a top perspective view of a two-dimensional array of actuators, the sectional view of FIG. 1(*a*) corresponding to a cross-section along the line A—A in FIG. 1(*b*). FIG. 1(*b*) also shows an optional dividing and support wall 101 provided to alter the ink flow characteristics.

As shown in FIG. 1(*a*), the wall 31 of the actuator 30 extends circumferentially around a central cavity 32, substantially co-axial with the axis of the nozzle 19, and is topped by a circular roof portion 34 which has a diameter r1. Preferably the roof portion is formed as a unitary piece with the walls 31 by moulding and to this end wall 31 is tapered relative to the chamber axis. Other machining methods such as calendering and mechanical grinding may also be suitably applicable and it is of course possible to form the roof portion 34 from a circular disc and attach it to the top of the wall 31 during assembly.

Electrodes 24, 25 are formed by sputtering or any other suitable method on both sides of the piezoelectric sheet 14, those areas of the sheet where electrodes are not required being protected by conventional lithographic resist which is applied via spin coating, exposed to a curing step at positions where the electrodes are not required, and washed to remove the uncured resist. As shown in FIG. 1(*a*), electrode 24 is formed on a surface of the cavity 32 extending in the direction of the nozzle axis and electrode 25 is formed on the face of the actuator 30 abutting the ink chamber 22.

In this embodiment the electrodes extend substantially over the entire top surface of the piezoelectric sheet 14 except on the very top of the roof portion 34, and over the interior surface and part of the base part 10 of the wall 31 on the underside of the piezoelectric sheet 14.

Electrodes 24, 25 allow an electric field to be applied to the piezoelectric material of the wall 31 for both polarisation and actuation purposes. In the former case, a high value of potential difference is applied so as to align the dipoles of the piezoelectric material as indicated by arrows 30'in FIG. 1(*a*). Such a process is well known in the art and will not be described in greater detail here. However, it will be noted that the roof portion is substantially un-poled and does not contribute to droplet ejection. It would of course be possible to pole the roof portion 34, but this would complicate manufacture.

Electrodes 24, 25 are subsequently connected so as to allow actuation of the poled piezoelectric wall. By means of a conducting interposer plate 17, electrode 25 is connected to a common ground whilst voltages are selectively applied to electrode 24 vis contact 40 and track 43 formed in substrate 44. FIG. 1(*c*) is a rear perspective view of the array of FIG. 1(*b*) in which the annular portion of electrode 24 to be connected to the substrate is clearly visible.

Upon the application of an electric field between the electrodes 24 and 25, the wall 31 acts in so-called "direct mode" whereby it either narrows and elongates toward the nozzle 19 or thickens and contracts away from the nozzle 19 depending on the direction of the electric field in relation to the direction of poling. This movement generates an acoustic wave in the ink chamber 22 which travels radially within the chamber, is reflected in the ink channel 15 to converge in the centre of the ink chamber 22 to effect ejection of the ink from the nozzle 19. The volume strain or condensation as the pressure wave recedes from the nozzle develops a flow of ink from the nozzle outlet aperture for a period R/c where c is the effective acoustic velocity of the ink in the chamber and R is the radial distance to the walls of the chamber. A droplet of ink is expelled during this time period. After a time R/c the pressure becomes negative, ink emission ceases and the applied voltage can be removed. Subsequently, as the pressure wave is damped, ink ejected from the ink chamber 22 is replenished from the ink channels 15 and the droplet cycle can be repeated. A number of pulses in quick succession can be applied to deposit a correspondingly-sized ink droplet on the substrate, as is known in the art.

Figure 2A:
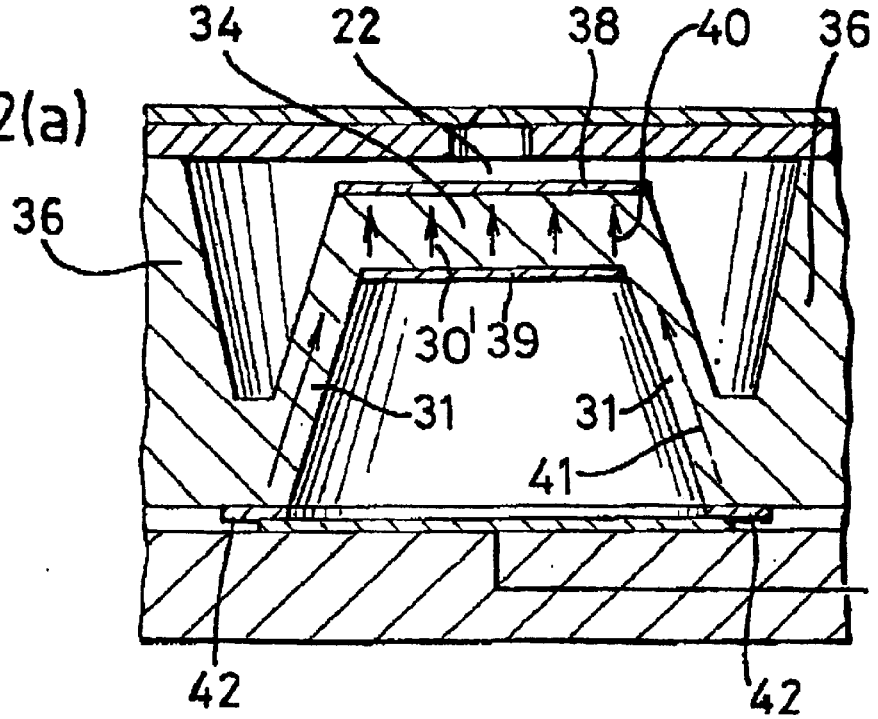
FIGS. 2(*a*) and 2(*b*) are sectional views of a second embodiment of a single actuator of a drop-on-demand ink jet printing apparatus.
Figure 2B:
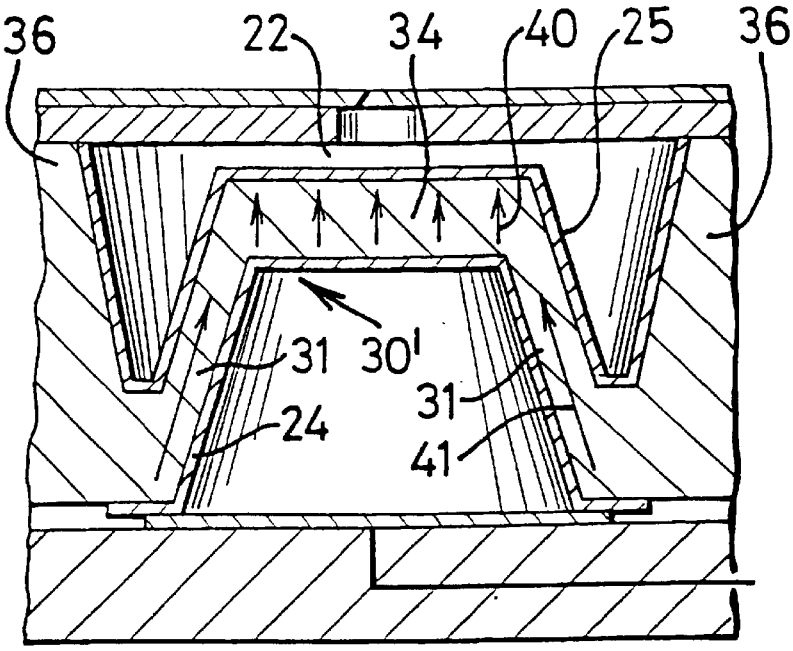

FIGS. 2(*a*) and 2(*b*) depict a second embodiment of a drop-on-demand ink jet printing apparatus according to the invention. Essentially, the layers and materials of the apparatus are similar to those of the first embodiment. However, in this second embodiment the method of polarization and the direction of polarization of the actuator 30 are different to those of the first embodiment and require the following steps to achieve the correct polarization arrangement.

With reference to FIG. 2(*a*), initially polarization electrodes 38,39 are deposited on the top and bottom surfaces of the roof portion 34 using a similar method to that described earlier and the piezoelectric sheet is polarized in the direction of the arrows 40. The bottom electrode 39 is then removed and a new electrode 42 applied to the bottom of the wall 31 so as to allow a polarising potential difference to be applied to wall 31 in axial direction 41. Both the polarization electrodes are then removed, ejection electrodes 24,25 applied over the entire top and bottom surfaces of the piezoelectric sheet 14 and the printhead assembled, as shown in FIG. 2(*b*).

During operation, the wall 31 deflects in so-called "shear mode" towards and away from the centre of the central cavity 32 whilst the roof portion 34 expands towards and away from the nozzle in direct mode, the resultant displacement of the roof portion generating a radial acoustic wave in the ink.

Similar to the first embodiment, this actuator 30 could be formed from two distinct parts.

In the embodiments of FIGS. 1 to 2, ink chamber 22 communicates with a nozzle 19 formed in nozzle plate 18 via an orifice 20 formed in an interposer plate 17. The interposer plate 17 is preferably a metallic plate having a coefficient of expansion similar to that of the piezoelectric sheet 14. The orifices 20 are preferably formed by etching using a photolithographic process or may similarly be made by drilling or electrochemical etching. The nozzle plate 18 preferably formed of a polyimide, for example, Upilex (Ube), is attached to the interposer plate 17. Whilst a polyimide nozzle plate is preferred, other polymeric materials or metallic components are suitably applicable. The nozzle plate may be coated with a hydrophobic coating that improves its non-wetting capabilities.

Figure 3:
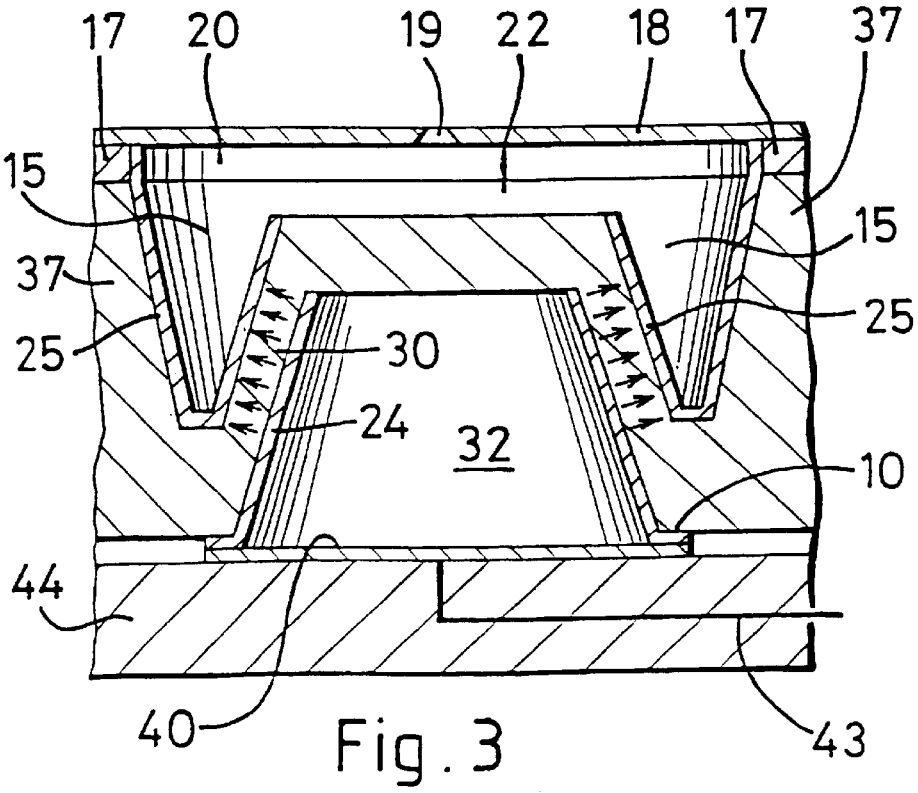
FIG. 3 is a sectional view of a third embodiment of a single actuator of a drop-on-demand ink jet printing apparatus.

It will be noted that in these previous embodiments, recessing the top surface of the roof portion 34 below that of the supporting walls forms the ink chamber 22. In an alternative embodiment, as shown in FIG. 3, the top surface of the roof portion 34 and the top surface of the supporting walls 36 are planar and indeed have been lapped to ensure their flatness. The ink chamber 22 is thus formed by increasing the diameter of the orifice 20 in the interposer plate 17 to be substantially equal to that of the spacing of the internal surfaces of the supporting walls 36. Preferably the spacing of the internal surfaces of the supporting walls 36 is 900 $\mu$m, and this is the same size as the diameter of the orifice in the interposer plate.

In such a construction, the height of the ink chamber is defined by the thickness of the interposer rather than the relative dimensions of the roof portion and supporting walls of the piezoelectric member. This has the primary advantage of allowing the ink chamber to be sized accurately and uniformly over a whole array of ink ejectors since the interposer plate is amenable to manufacture to much higher tolerances than moulded piezoelectric sheet 17. A secondary advantage is to be able to vary the height of the ink chamber—and thus the velocity of the droplets ejected from that chamber—simply by varying the thickness of the interposer. This allows printheads to be tailored to printing applications where particularly high (or low) ink ejection velocities are required.

Figure 4:
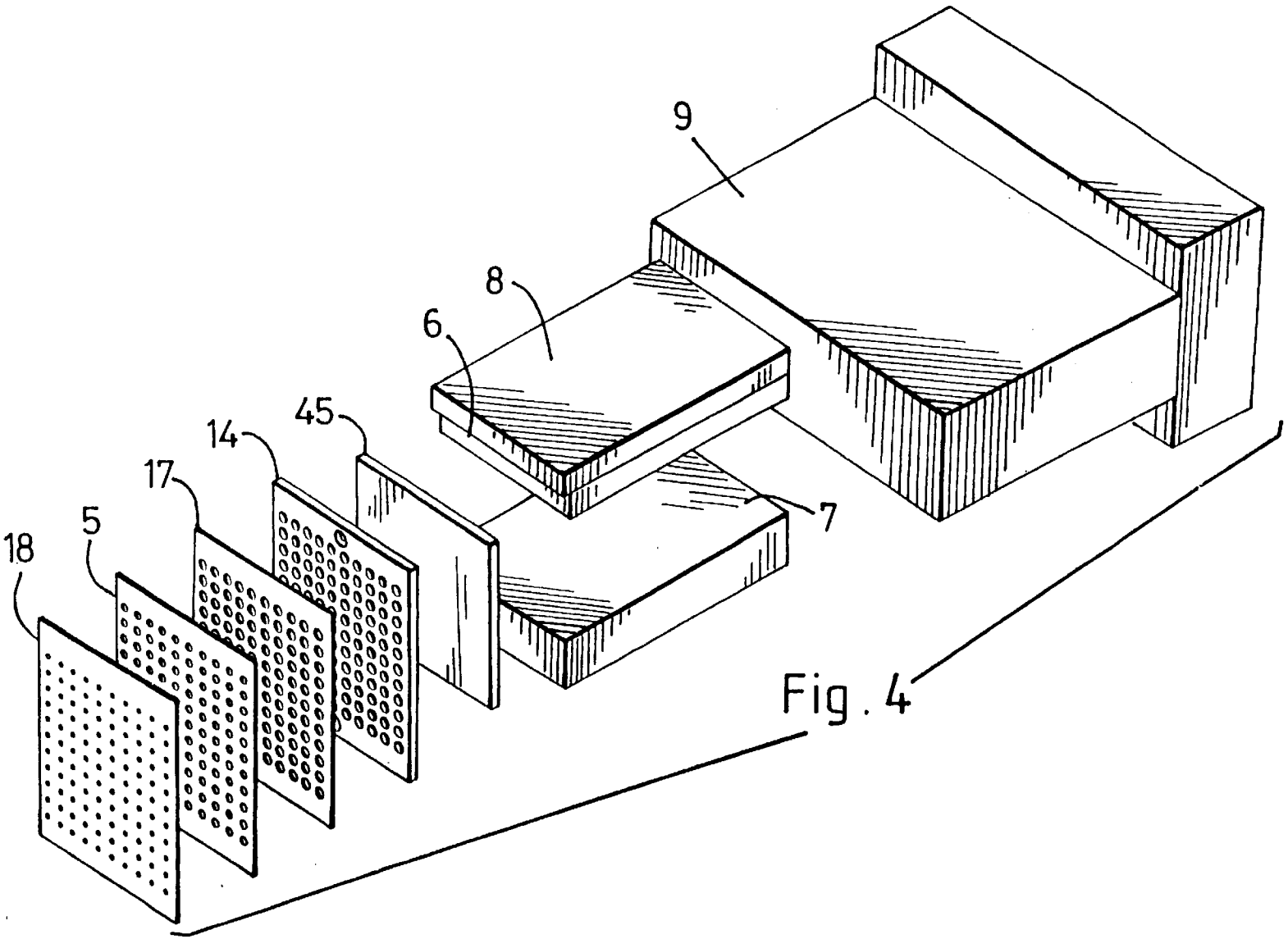
FIG. 4 is an exploded perspective view of a drop-on demand ink jet printing apparatus including an array of actuators shown in FIG. 3.

Whilst the thickness of the interposer plate is preferably of the order of 100 $\mu$m, it may lie in the range of 25 to 150 $\mu$m.

Where as in the embodiment of FIG. 3, a simple polyimide nozzle plate spans a relatively large distance, a further interposer may be employed to support and stiffen the nozzle plate. Such a further Interposer plate is shown in the third embodiment of FIG. 4 which also shows a five layer laminate comprising nozzle plate 18, a first interposer layer 5, a second interposer layer 17, a piezoelectric layer 14, and an electrical connect substrate layer 44. The laminate is joined to an ink supply via tubes 6 formed in support plate 7 and 8. These are attached to an aluminium chassis 9.

The nozzle plate 18 can be bonded to the first interposer layer either before or after attachment of the first interposer layer to the second interposer layer. Preferably both the first and second interposer layers are metal plates etched to form orifices therein using a standard photolithographic process. Preferably the thickness of both interposer plates is 50 $\mu$m but this can be varied to alter the ejection characteristics. The orifices in the second interposer plate are preferably 900 microns in diameter and this corresponds to the diameter of the ink chamber 22.

The nozzles formed in the nozzle plate are central with respect to the diameters of orifices in the two interposer plates and the ink chamber and are preferably spaced apart by 1/360th of an inch (0.0705 mm) in the scanning direction and 17/256th of an inch (1.687 mm) in the paper feed direction. The unequal spacings in the x and y directions reduce overload and power surges on the chips. It is of course possible to have dot spacing other than 1/360th of an inch (0.0705 mm) simply by varying the distance between the centres of the ink chambers. However increasing the dot spacing by 2 means that an increased number of passes of the head are required to achieve the same dot density on the paper. As increasing the dot spacing in one direction affects the dot spacing in the other direction, the number of passes required increases by more than 2 and hence coverage of a page becomes slower. It is believed that there is an optimum range of dot spacings between 1/720th and 1/180th of an inch (0.0352 mm and 0.141 mm).

The roof portion 34 of each actuator preferably has a diameter of 700 $\mu$m. The height of the actuator in the direction of the nozzle axis is preferably 700 $\mu$m and the thickness of the wall 31 is preferably 70 $\mu$m. With these dimensions of the actuator it possible to effect a 30 nm displacement of the actuator in the direction of the nozzle plate for a 20V input.

The actuators shown in the first to third embodiments are in fluid communication with a single ink manifold 102 and hence eject a single colour. It is of course possible to provide more than one manifold and dividing wall to manufacture a multi-colour head.

Figure 5:
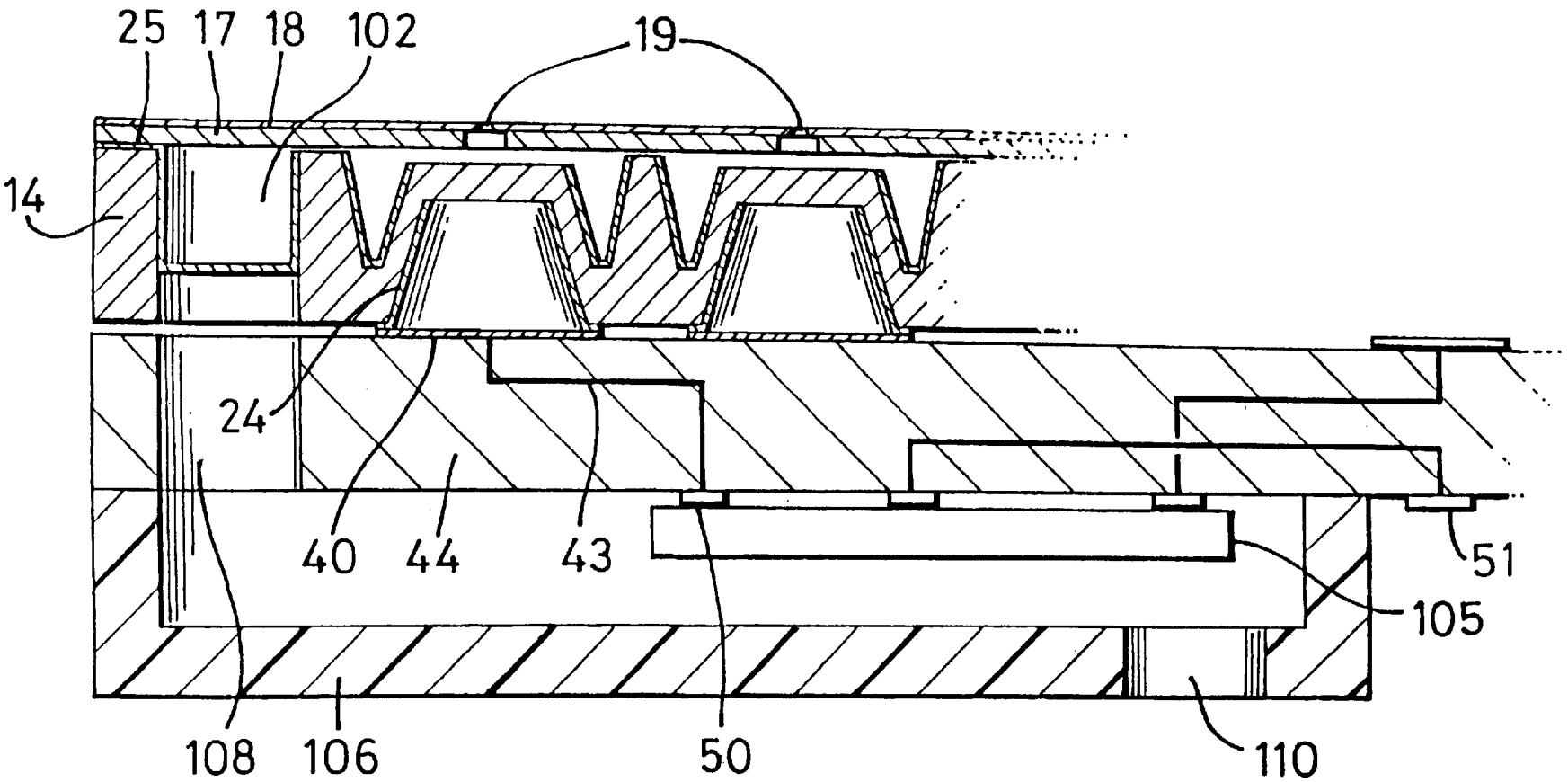
FIG. 5 is a sectional view illustrating the electrical connections in a drop-on-demand ink jet printing apparatus.

FIG. 5 shows the preferred method of electrical connection between the drop-on-demand ink jet printing apparatus and the associated drive circuitry.

Figure 7:
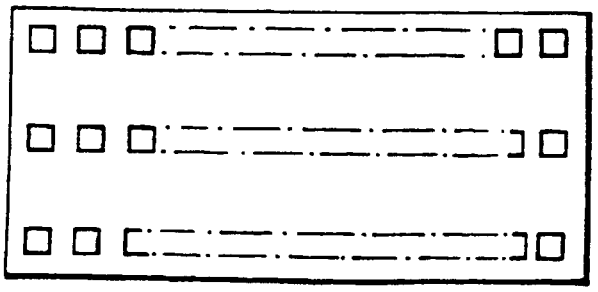
FIG. 7 shows a layout of contacts on a chip face.
Figure 8A:
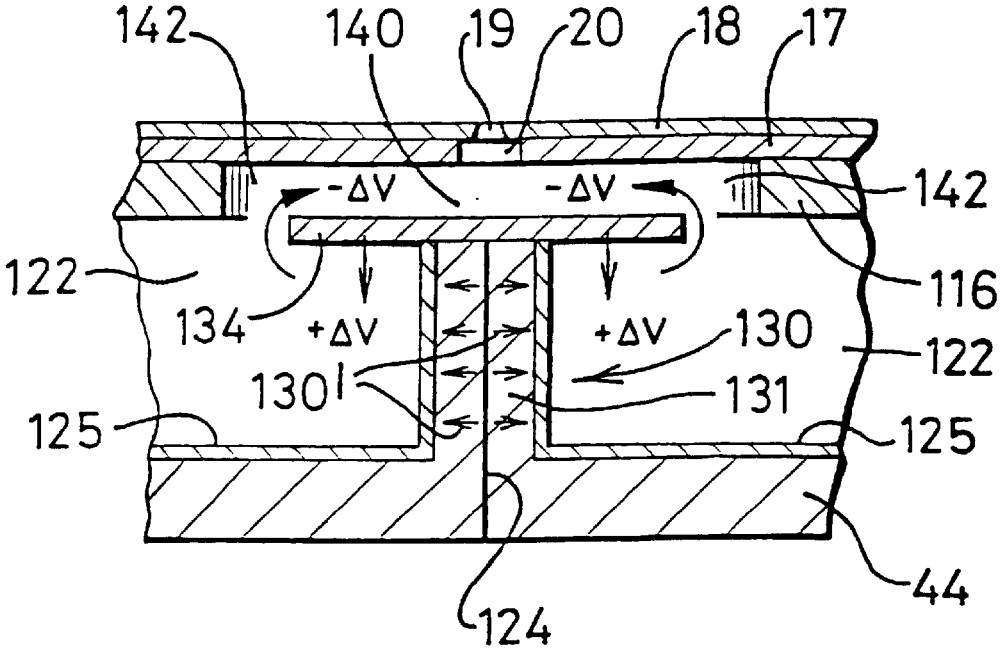
FIG. 8(*a*) is a sectional view of a fourth embodiment of a single actuator of a drop-on-demand ink jet printing apparatus.
Figure 8B:
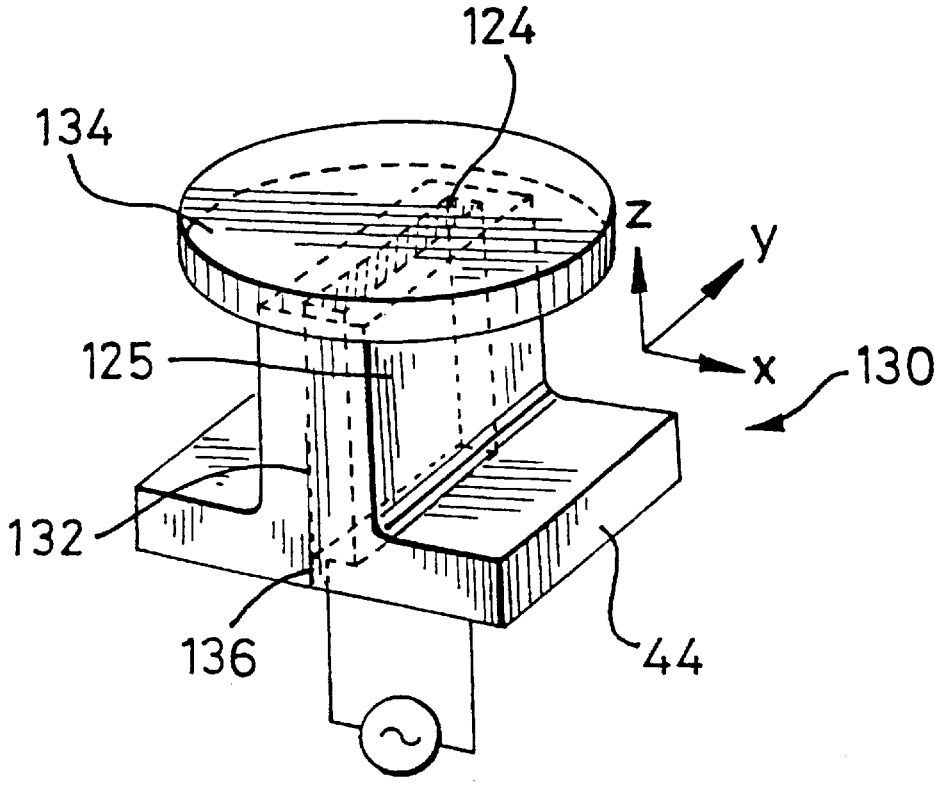
Figure 8C:
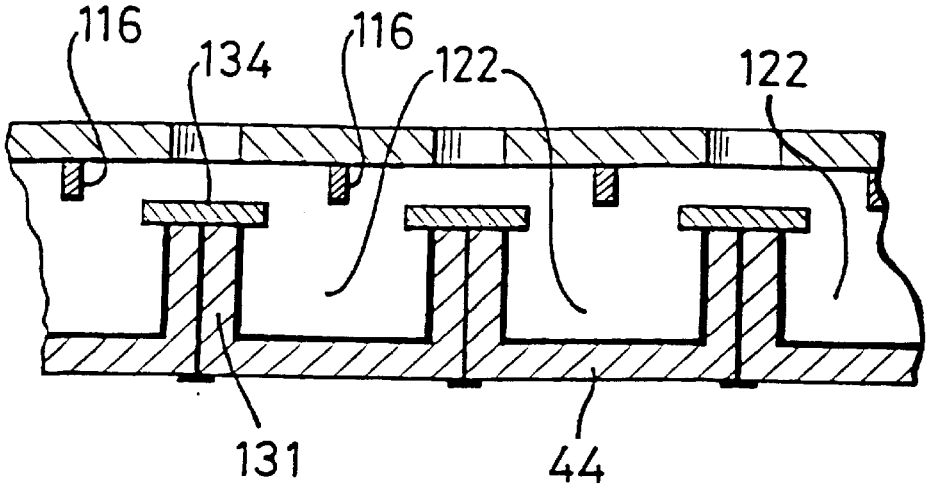
Figure 8D:
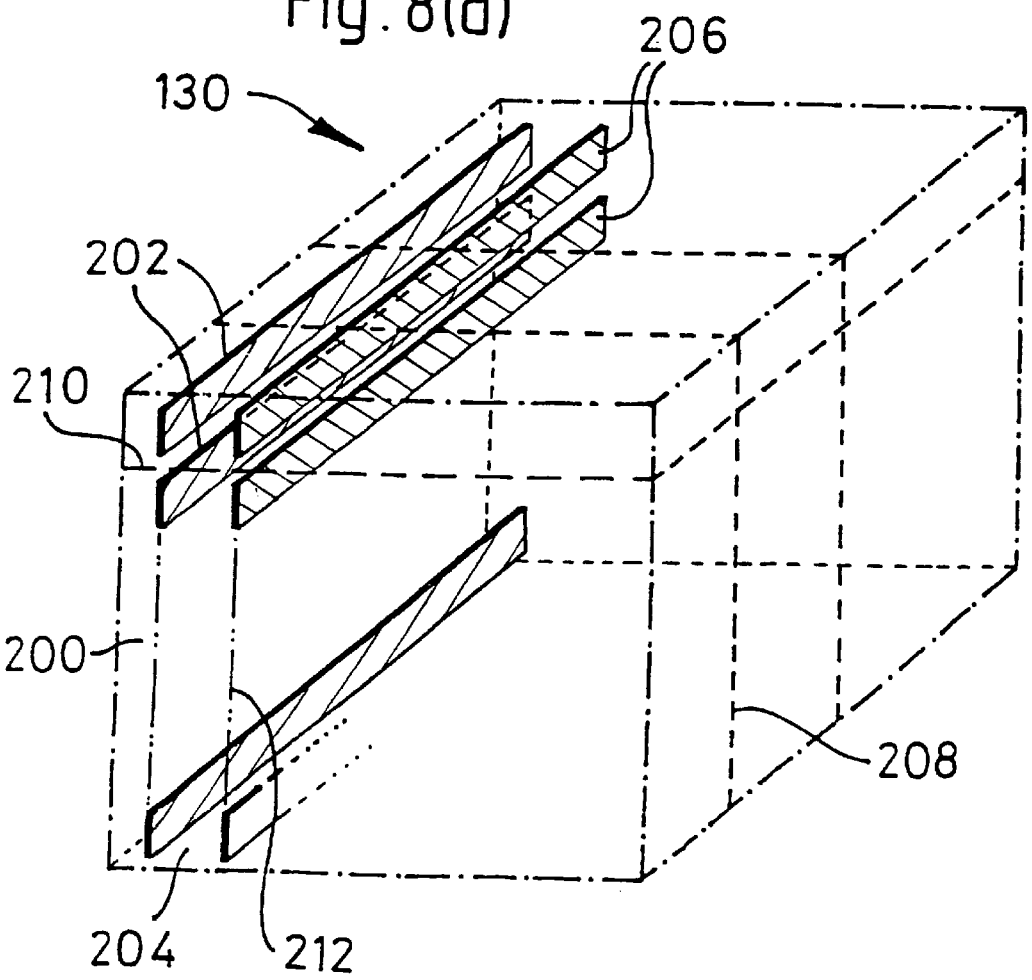

Piezoelectric sheet 14, interposer plate 17 and nozzle plate 18 are mounted on top of a thick film hybrid circuit board 44. Such circuit boards are known in the art. Integrated circuit (chip) 105 Is mounted on the opposite side of board 44 where it connects with conductive pads 50 which can be distributed over the whole of the footprint (rather than just at the edges) of the chip thanks to the multi-layer construction of board 44. An example of the layout of the chip face is depicted in FIG. 7; twenty five inputs may be made via centrally located conductive pads whilst outputs to thirty two actuators are made by each of two rows located at the chip periphery. This means that the chips can be interconnected at a thick film hybrid density and that all connections can be made largely within the confines of the area of the nozzle array, and in the embodiment shown in FIG. 5 can be cooled by direct contact with the ink.

Attached to circuit board 44 is a cover 106 which, in addition to protecting chips 105, may also serve as a conduit for ink between an inlet 110 and a bore 108 formed in the circuit board and communicating with manifold 102 of the piezoelectric sheet 14. This allows cooling of the chips by the ink and, to this end, the chips preferably have a coating, for example, paralene, to protect against chemical attack by the ink. Alternatively, reliability considerations may dictate that ink supply to bore 108 is kept independent of cover 106 and the electronic components therein.

Figure 6:
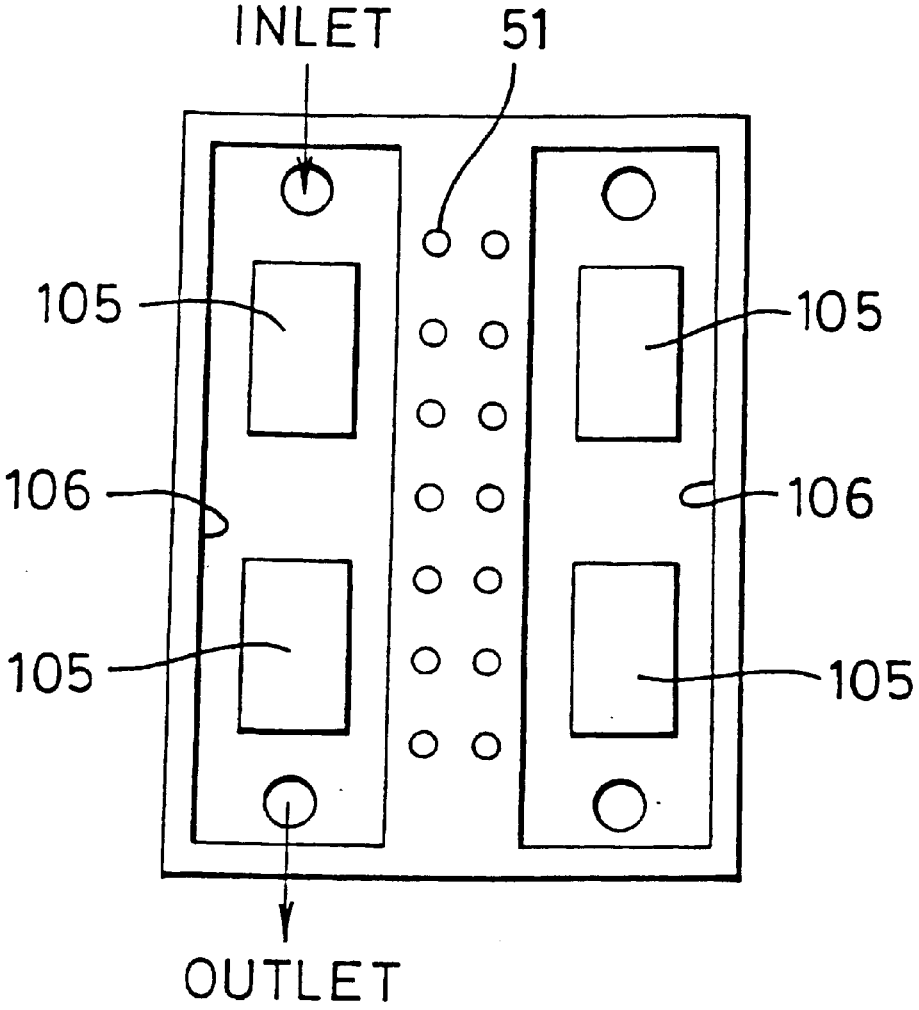
FIG. 6 shows a layout of chips on the back surface of a thick film hybrid.

FIG. 6 shows a possible layout of the chips on the back surface of the thick film hybrid 4. Input contacts 51 are located exterior to the plastic manifolds which each contain two chips 105. Ink is fed through one of the feed tubes and out of the other feed tube to effect a continuous ink circulation through the printhead. The ink can therefore be cooled, heated, degassed or filtered before being recycled back to the printhead.

The actuator can be almost entirely pre-testable. By the production of chip pads on the reverse of the piezoelectric sheet 14, the ejection characteristics can be tested and measured prior to the attachment of the chips, and similarly the chips can be tested once before the addition of the piezoelectric sheet. Once the circuit board 44 and the piezoelectric sheet 14 have been tested and joined they form a completely self contained module and depending on the method of connecting to the chassis both electrically and mechanically, can also be replaceable. This is particularly advantageous in the case of a pagewide array made up of several such modules.

FIG. 8(*a*) is a sectional view of a fourth embodiment of a single actuator of a drop-on-demand ink jet printing apparatus. A top perspective view of this actuator is shown in FIG. 8(*b*).

In this fourth embodiment, the actuator 130 comprises a wall 131 of piezoelectric material extending in the direction of the axis of the nozzle 19 formed in the nozzle plate 18. The base of the wall 131 is integral with, or otherwise bonded to, substrate 44. As shown more clearly in FIG. 8(*b*), the wall 131 surrounds a cavity 132 formed in the wall 132, the cavity being coaxial with the nozzle axis such that the wall 131 extends around the nozzle axis.

The wall 131 is topped with a roof portion in the form of a circular disc 134. The disc 134 is attached to the top of the wall during assembly, and has a diameter substantially equal to or greater than the length of the wall extending in the Y axis shown in FIG. 8(*b*), that is, in a directional substantially orthogonal to the nozzle axis. The disc 134 may also be formed from piezoelectric material, or from any other suitable material which is sufficiently stiff so as not to flex during movement thereof.

An electrode 124 is formed within the cavity 132 in the wall 131. A channel 136 is formed in the substrate 44 to enable the electrode 124 to be connected to voltage source for selectively applying a voltage to the electrode 124. Electrodes 125 are formed by sputtering or any other suitable method on both sides of the wall 131 abutting the ink chamber 22 (and also possibly over the entire outer surface of the actuator) and over the upper surface of the substrate 44. Electrodes 125 are typically ground.

Electrodes 124, 125 allow an electric field to be applied to the piezoelectric material of the wall 131 for both polarisation and actuation purposes. In the former case, a high value of potential difference is applied so as to align the dipoles of the piezoelectric material as indicated by arrows 130'in FIG. 8(*a*). Such a process is well known in the art and will not be described in greater detail here. However, it will be noted that the disc 134 is substantially un-poled and does not contribute to droplet ejection. It would of course be possible to pole the disc 134, but this would complicate manufacture.

With reference to FIG. 8(*b*), electrodes 124, 125 are subsequently connected so as to allow actuation of the poled piezoelectric wall. Upon the application of an electric field between the electrodes 124 and 125, the wall 131 acts in so-called "direct mode" whereby it either narrows and elongates toward the nozzle 19 or thickens and contracts away from the nozzle 19 depending on the direction of the electric field in relation to the direction of poling. This movement generates an acoustic wave in the ink ejection chamber 140 in fluid communication with the chamber 122. The acoustic wave travels radially within the chamber 140, is reflected by an ink channel 142 defined between the chambers 122 and 140 by interposer plates 17 and 116 to converge beneath the nozzle 19 to effect ejection of the ink from the nozzle 19. The volume strain or condensation as the pressure wave recedes from the nozzle develops a flow of ink from the nozzle outlet aperture for a period R/c where c is the effective acoustic velocity of the ink in the chamber 140 and R is the radial distance to the walls 116 of the chamber 140. A droplet of ink is expelled during this time period. After a time R/c the pressure becomes negative, ink emission ceases and the applied voltage can be removed. Subsequently, as the pressure wave is damped, ink ejected from the ink chamber 140 is replenished from the ink chamber 122 and the droplet cycle can be repeated. A number of pulses in quick succession can be applied to deposit a correspondingly-sized ink droplet on the substrate, as is known in the art.

FIG. 8(*c*) is a simplified diagram illustrating an array of actuators according to this fourth embodiment. As shown in FIG. 8(*c*), neighbouring actuators share a common ink chamber 122. Cross-talk between neighbouring actuators is minimised by localised flow of ink over the disc 134. The size of the ink chamber 122 serves to reduce the pressure difference between the extremities of the two-dimensional array, thus improving textile printing where larger amounts of ink are deposited over a greater printing width.

FIG. 8(*d*) illustrates one method of manufacture of the actuators 130. Firstly, layer 200 of piezoelectric material, such as tape cast green PZT, is laid down. Secondly, a pattern of electrode tracks 202 are formed on the layer 200 using screen printing or similar (although FIG. 8(*d*) illustrates two electrode tracks, any number may be formed at this stage). Thirdly, a second layer 204 of piezoelectric material is laid on top of the layer 200 and 204, such that each electrode track 202 is surrounded by piezoelectric material. A further pattern of electrode tracks is formed on layer 204, and the process repeated as required to form a laminated block having the required number of layers of piezoelectric material. The block is then fired to form a rectangular block (typically of dimension 18 mm×25 mm×100 mm), which is machined along lines 208, 210 and 212 to form a individual or joined actuators.

Figure 9A:
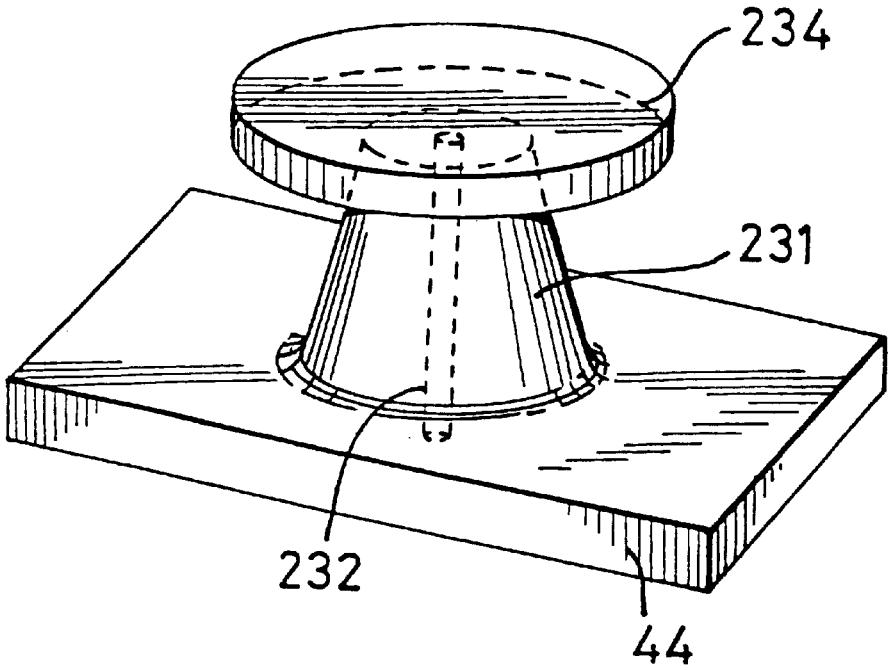
FIG. 9(*a*) is a perspective view of a fifth embodiment of a single actuator of a drop-on-demand ink jet printing apparatus.
Figure 9B:
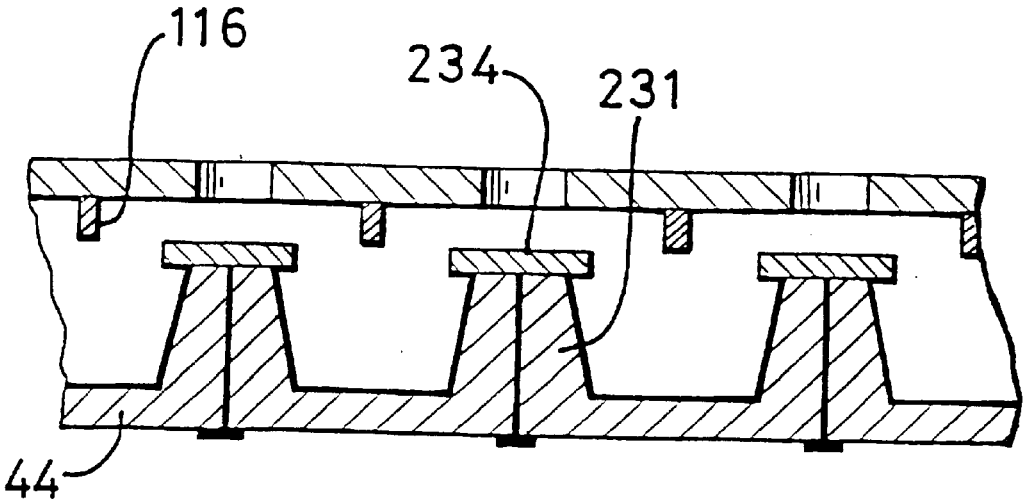

FIG. 9(*a*) illustrates a perspective view of a fifth embodiment of a single actuator of a drop-on-demand ink jet printing apparatus. The fifth embodiment is similar to the fourth embodiment, with the exception that the actuating structure is replaced by a frustro-conical actuating structure 231, tapering towards the nozzle. The actuating structure 231 may be integral with the substrate 44, or otherwise connected thereto. Similar to the fourth embodiment, the actuating structure extends around the nozzle axis and electrodes (not shown in FIG. 9(*a*)) are provided in the cavity 232 and the external faces of the structure 231 to allow an electric field to be applied to the piezoelectric material of the structure 231 for both polarisation and actuation purposes. FIG. 9(*b*) illustrates an array of such actuators in a drop-on-demand printing apparatus, the array being similar to that shown in FIG. 8(*c*).

The cavity 232 may be formed in the structure 231 by any suitable method, for example by drilling a cavity of substantially circular cross-section through the structure 231 and substrate 44, as shown in FIG. 9(*a*) using a laser, or alternatively forming a trench-like cavity as shown in FIG. 8(*b*). An electrode may then be formed in the thus-formed cavity by pumping plating fluid through the cavity and solidifying.

Figure 10A:
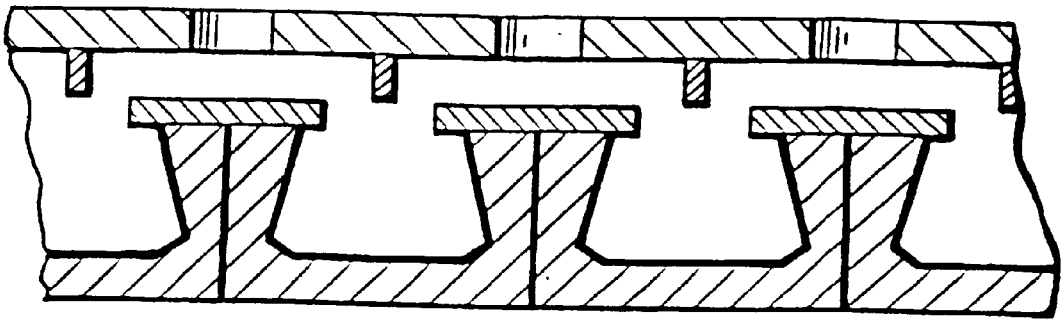
FIG. 10(*a*) is a simplified diagram of an array of actuators according to a sixth embodiment.
Figure 10B:
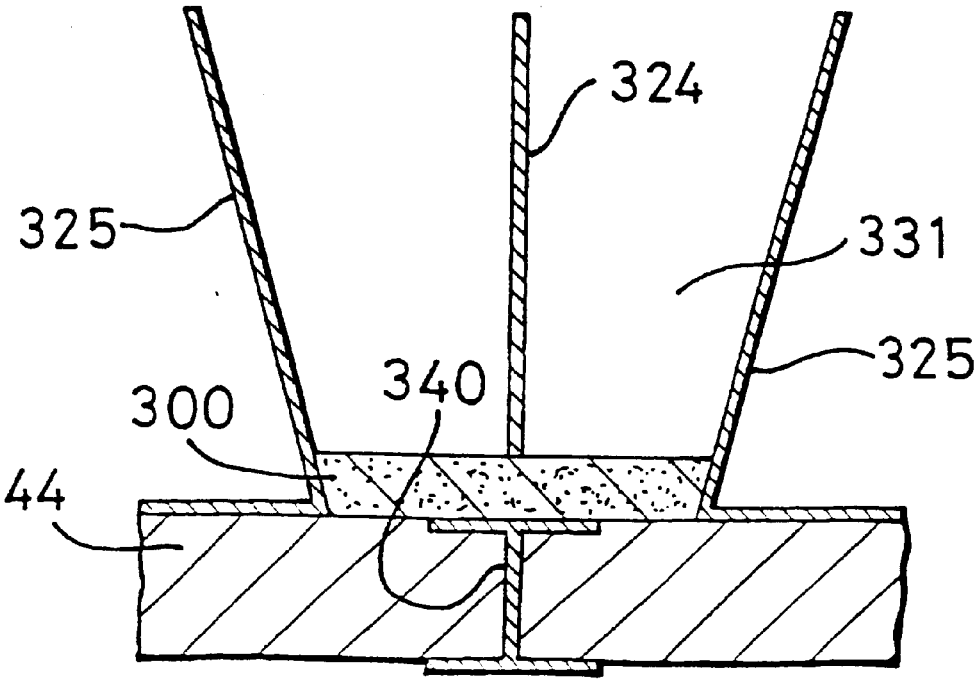

FIG. 10(*a*) shows a similar array of actuators in drop-on-demand printing apparatus according to a sixth embodiment. The actuators of this sixth embodiment are similar to those of the fifth embodiment, except that the actuating structures are inverted with respect to those of the fifth embodiment. The structures may be integral with the substrate, or alternatively may be bonded thereto. The structures may be bonded to the substrate prior to forming the respective cavities in the structures and substrate, or alternatively may be bonded thereto after electrodes have been formed in cavities in the structures and substrate. In this arrangement, as shown in FIG. 10(*b*), each structure 331 is bonded to the substrate 44 using anisotropic glue 300 to allow conduction between the electrode 324 formed in the cavity of the structure and the contact 340 formed in the substrate but to prevent short circuiting between the electrodes 324 and 325.

What is claimed is:

1. Drop-on-demand ink jet printing apparatus comprising a nozzle on a nozzle axis; an ink chamber communicating with the nozzle; a piezoelectric actuating structure, said structure extending around the nozzle axis and extending in the direction of the nozzle axis; an actuating surface bounding the chamber and facing towards the nozzle, said structure being actuable to move said actuating surface in the direction of the nozzle axis to effect droplet ejection through the nozzle; and electrodes for applying an actuating electric field to the actuating structure.

2. Apparatus according to claim 1, wherein the electrodes comprise a first electrode on a face of the actuating structure abutting the ink chamber and a second electrode on an opposing face of the actuating structure isolated from the ink chamber.

3. Apparatus according to claim 2, wherein the first electrode is ground.

4. Apparatus according to claim 1, wherein the ink chamber extends radially about the nozzle axis, and the actuating structure is actuable to move the actuating surface in the direction of the nozzle axis to effect, through acoustic wave travel in the ink chamber radially of the axis of the nozzle, droplet deposition through the nozzle.

5. Apparatus according to claim 4, wherein the ink chamber extends a radial distance R from the nozzle axis and the actuating structure is actuable to move in the direction of the nozzle axis in a time which is at most half of the time R/c, where c is the speed of sound through ink in the ink chamber.

6. Apparatus according to claim 4, wherein the ink chamber is bounded by a generally circular structure providing a change in acoustic impedance serving to reflect acoustic waves traveling in the ink chamber radially of the nozzle axis.

7. Apparatus according to claim 6, wherein said change in acoustic impedance is effected through a change in ink depth in the direction of the nozzle axis.

8. Apparatus according to claim 6, wherein said circular structure defines an annulus of ink about the ink chamber which in the direction of the nozzle axis is of a depth different from the depth of the ink chamber.

9. Apparatus according to claim 4, wherein the ink chamber extends a radial distance R from the nozzle axis and the actuating structure is actuable to move in the direction of the nozzle axis in a time which is at most half of the time R/c, where c is the speed of sound through ink in the ink chamber.

10. Apparatus according to claim 4, wherein the ink chamber is bounded by a generally circular structure providing a change in acoustic impedance serving to reflect acoustic waves traveling in the ink chamber radially of the nozzle axis.

11. Apparatus according to claim 10, wherein said change in acoustic impedance is effected through a change in ink depth in the direction of the nozzle axis.

12. Apparatus according to claim 10, wherein said circular structure defines an annulus of ink about the ink chamber which in the direction of the nozzle axis is of a depth different from the depth of the ink chamber.

13. Apparatus according to claim 1, further comprising ink supply means in fluid communication with the ink chamber for replenishment of the ink chamber following droplet ejection.

14. Apparatus according to claim 13, wherein the ink supply means is disposed at a plurality of locations disposed circumferentially about the ink chamber.

15. Apparatus according to claim 13, wherein the ink supply means serves to supply ink to the ink chamber around substantially the entire periphery of the ink chamber.

16. Apparatus according to claim 1, wherein the actuating structure tapers towards the nozzle axis.

17. Apparatus according to claim 1, wherein the actuating structure is homogeneous and so poled in relation to the actuating electric field as to deflect in direct mode.

18. Apparatus according to claim 17, wherein the actuating structure is poled in a direction transverse to the faces thereof, the electric field being applied in a direction transverse to the faces of the actuating structure.

19. Apparatus according to claim 1, wherein the actuating structure is homogeneous and so poled in relation to the actuating electric field as to deflect in shear mode.

20. Apparatus according to claim 19, wherein the actuating structure is poled in directions which converge towards the nozzle axis, the electric field being applied in a direction transverse to the faces of the actuating structure.

21. Apparatus according to claim 20, wherein the actuating surface comprises a disc of piezoelectric material, the piezoelectric disc being poled in the direction of the nozzle axis so as to deflect in direct mode upon actuation of the electric field.

22. Apparatus according to claim 1, comprising a plurality of said nozzles, each having a respective nozzle axis, said nozzle axes being provided in parallel; a plurality of said ink chambers, each extending about a respective nozzle axis; and a homogeneous piezoelectric sheet having a two dimensional array of said actuating structures, each actuating structure being associated with a respective ink chamber.

23. Drop-on-demand ink jet printing apparatus comprising a nozzle on a nozzle axis; an ink chamber communicating with the nozzle; a piezoelectric actuating structure, said structure extending in the direction of the nozzle axis; an actuating surface bounding the chamber and facing towards the nozzle, said structure being actuable to move said actuating surface in the direction of the nozzle axis to effect droplet ejection through the nozzle; and electrodes for applying an actuating electric field to the actuating structure, said electrodes comprising a first electrode on a face of the actuating structure abutting the ink chamber and a second electrode on an opposing face of the actuating structure isolated from the ink chamber.

24. Apparatus according to claim 23, wherein the first electrode is ground.

25. Apparatus according to claim 23, wherein the ink chamber extends radially about the nozzle axis, and the actuating structure is actuable to move the actuating surface in the direction of the nozzle axis to effect, through acoustic wave travel in the ink chamber radially of the axis of the nozzle, droplet deposition through the nozzle.

26. Apparatus according to claim 23, further comprising ink supply means in fluid communication with the ink chamber for replenishment of the ink chamber following droplet ejection.

27. Apparatus according to claim 26, wherein the ink supply means is disposed at a plurality of locations disposed circumferentially about the ink chamber.

28. Apparatus according to claim 26, wherein the ink supply means serves to supply ink to the ink chamber around substantially the entire periphery of the ink chamber.

29. Apparatus according to claim 23, wherein the actuating structure tapers towards the nozzle axis.

30. Apparatus according to claim 23, wherein the actuating structure is homogeneous and so poled in relation to the actuating electric field as to deflect in direct mode.

31. Apparatus according to claim 30, wherein the actuating structure is poled in a direction transverse to the faces thereof, the electric field being applied in a direction transverse to the faces of the actuating structure.

32. Apparatus according to claim 23, wherein the actuating structure is homogeneous and so poled in relation to the actuating electric field as to deflect in shear mode.

33. Apparatus according to claim 32, wherein the actuating structure is poled in directions which converge towards the nozzle axis, the electric field being applied in a direction transverse to the faces of the actuating structure.

34. Apparatus according to claim 33, wherein the actuating surface comprises a disc of piezoelectric material, the piezoelectric disc being poled in the direction of the nozzle axis so as to deflect in direct mode upon actuation of the electric field.

35. Apparatus according to claim 23, comprising a plurality of said nozzles, each having a respective nozzle axis, said nozzle axes being provided in parallel; a plurality of said ink chambers, each extending about a respective nozzle axis; and a homogeneous piezoelectric sheet having a two dimensional array of said actuating structures, each actuating structure being associated with a respective ink chamber.

36. A method of ink jet printing comprising the steps of establishing a planar body of ink in communication with a nozzle having a nozzle axis, the body of ink extending radially of the nozzle axis; providing in the body of ink an impedance boundary extending circumferentially of the nozzle axis; and selectively actuating a piezoelectric actuating structure extending in the direction of the nozzle axis and around the nozzle axis to move an actuating surface in the direction of the nozzle axis so as to establish an acoustic wave travelling radially of the nozzle axis in the ink chamber and reflected by the impedance boundary, thereby to effect ejection of an ink droplet through the nozzle.

37. A method according to claim 36, wherein the body of ink extends a radial distance R from the nozzle axis, the actuating structure being moved in the direction of the nozzle in a time which is at most half of the time R/c, where c is the speed of sound through ink in the ink chamber.

38. A method according to claim 36, wherein electrodes are provided for applying an actuating electric field to the actuating structure to effect movement of the actuating structure in the direction of the nozzle axis.

39. A method according to claim 38, wherein the actuating structure tapers towards the nozzle axis.

40. A method according to claim 36, wherein the actuating structure is poled in relation to the actuating electric field as to deflect in direct mode.

41. A method according to claim 40, wherein the actuating structure is poled in a direction transverse to the faces thereof, the actuating electric field being applied in a direction transverse to the faces of the actuating structure.

42. A method according to claim 36, wherein the actuating structure is so poled in relation to the actuating electric field as to deflect in shear mode.

43. A method according to claim 42, wherein the actuating structure is poled in directions which converge towards the nozzle axis, the actuating electric field being applied in a direction transverse to the faces of the actuating structure.

44. A method according to claim 36, wherein the actuating surface comprises a disc of piezoelectric material, the disc being poled in the direction of the nozzle axis so as to deflect in direct mode upon actuation.

45. A method according to claim 36, further comprising the step of replenishing the body of ink following ink droplet ejection by supplying ink thereto.

46. A method according to claim 45, wherein the ink is supplied at a plurality of locations disposed circumferentially about the body of ink.

47. A method according to claim 46, wherein the ink is supplied around substantially the entire periphery of the body of ink.

48. A method according to claim 36, wherein the impedance boundary is provided by changing the ink depth in the body of ink in the direction of the nozzle axis.

49. A method of manufacturing drop-on-demand ink jet printing apparatus, comprising the steps of forming a nozzle plate having a two dimensional array of nozzles each having a nozzle axis, said nozzle axes being parallel; forming a two dimensional array of actuating structures on a substrate each extending in the direction of a respective nozzle axis and around the respective nozzle axis and being associated respectively with the nozzles, an actuating surface being provided for each actuating structure; applying electrodes on the actuating structures enabling selective actuation of each wall; and laminating the nozzle plate and the substrate; the laminated structure providing a plurality of disc-shaped ink chambers each extending about a respective nozzle axis and communicating with the respective nozzle, such that in the manufactured apparatus, actuation of a selected structure effects drop ejection from the associated nozzle.

* * * * *